United States Patent [19]

Shannon

[11] 4,252,253

[45] Feb. 24, 1981

[54] DRINK DISPENSER HAVING CENTRAL CONTROL OF PLURAL DISPENSING STATIONS

[75] Inventor: Joseph W. Shannon, Kent, Ohio

[73] Assignee: McNeil Corporation, Akron, Ohio

[21] Appl. No.: 880,220

[22] Filed: Feb. 21, 1978

[51] Int. Cl.[3] ..... B67D 5/10

[52] U.S. Cl. ..... 222/25; 222/129.4; 222/144.5; 235/92 FL

[58] Field of Search ..... 222/25–28, 222/36–37, 129.1–129.4, 144 S, 76; 235/92 FL

[56] References Cited

U.S. PATENT DOCUMENTS

| | | | |
|---|---|---|---|
| 3,688,947 | 9/1972 | Reichenberger | 222/27 |
| 3,895,738 | 7/1975 | Buchanan et al. | 222/28 X |
| 3,927,800 | 12/1975 | Zinsmeyer et al. | 222/26 |
| 3,930,598 | 1/1976 | Slagle | 222/129.4 |
| 3,949,207 | 4/1976 | Savary et al. | 222/26 X |
| 3,991,911 | 11/1976 | Shannon et al. | 222/129.4 X |

*Primary Examiner*—Joseph J. Rolla

*Attorney, Agent, or Firm*—Oldham, Oldham, Hudak & Weber

[57] ABSTRACT

Drink dispensing apparatus is presented wherein a system including plural dispensing terminals communicates with a central source of beverage ingredients for dispensing. Each of the terminals is interconnected with a central microprocessor which communicates with each of the terminals and the source of beverage ingredients to dispense to the respective terminals the particular formulations selected thereat. Further presented is circuitry interfacing the microprocessor with the various terminals such that automatic pricing, inventory control, sales totalization, and other housekeeping techniques may be performed by the microprocessor on a terminal-by-terminal basis.

14 Claims, 19 Drawing Figures

DRINK DISPENSER HAVING CENTRAL CONTROL OF PLURAL DISPENSING STATIONS

BACKGROUND OF THE INVENTION

Heretofore, several types of mixed drink dispensing apparatus have been known and utilized in the art. An advancement in the art was presented in applicant's prior U.S. Pat. No. 3,991,911, wherein an operator may select, by actuation of switches upon a keyboard, the beverage composition which he desires to dispense. The components so selected are dispensed simultaneously, and circuitry is included to total the price of the drink as a function of the components and volumes thereof which are dispensed. Indeed, this prior art teaching provides a system wherein an operator may select preprogrammed drinks, or concoct his own at the request of a customer, with the components of the drink being simultaneously dispensed on a command by the operator and the price thereof being automatically calculated. However, this prior art teaching relates to a single dispensing terminal or station wherein one dispensing head, cash drawer, keyboard selection means, cash display register, and the like are associated with the required control circuitry and beverage storage rack wherein storage is made of the beverages capable of being dispensed. While such system was found to be highly reliable and cost effective, it has become desirable to increase the number of dispensing terminals or stations without duplicating the control circuitry and beverage storage complexity of the system so that plural dispensing terminals may be incorporated in the system with only slight increases in cost.

OBJECTS OF THE INVENTION

It is a particular object of the instant invention to present a drink dispenser having central control of plural dispensing stations, wherein a centralized microprocessor may be interfaced with each of a number of dispensing stations, each having its own keyboard, cash display board, dispensing head, and the like, and under control of the centralized microprocessor.

Another object of the invention is to present a drink dispenser having central control of plural dispensing stations, wherein a single storage rack maintaining reservoirs of each of the beverages capable of being dispensed may be provided in interconnection with the dispensing head at each of the various dispensing stations.

Still a further object of the invention is to present a drink dispenser having a central control of plural dispensing stations, wherein a single set of air valves and pumps are required in conjunction with a single storage rack for pumping beverages to the various dispensing stations for dispensing thereat.

Yet another object of the invention is to present a drink dispenser having central control of plural dispensing stations, wherein centralized storage of data respecting volume and value of beverages dispensing may be maintained for inventory control.

Still a further object of the invention is to present a drink dispenser having central control of plural dispensing stations, wherein the number of dispensing stations in a facility may be greatly increased with relatively minor increases in system cost.

SUMMARY OF THE INVENTION

The foregoing and other objects of the invention, which will become apparent as the detailed description proceeds, are achieved by apparatus for dispensing drinks in accordance with preprogrammed or operator-selected formulations, comprising: storage means for maintaining therein beverages for dispensing in the various formulations; a plurality of dispensing terminals, each in communicaton with such storage means, each terminal including both a selection means for allowing the operator to select the formulations to be dispensed and a dispensing means connected to said storage means for dispensing the drinks according to the selected formulations; and central control means interconnected between and in communication with said terminals and said storage means for sensing from each of said selection means the respectively selected formulations for dispensing at the various terminals and controlling the dispensing at said terminals from said storage means.

DESCRIPTION OF THE DRAWINGS

For a complete understanding of the objects, techniques, and structure of the invention, reference should be had to the following detailed description and accompanying drawings wherein:

FIG. 1 is a block diagram of the system of the invention;

DETAILED DESCRIPTION OF THE PREFERRED EMBODIMENT

Figure 9:
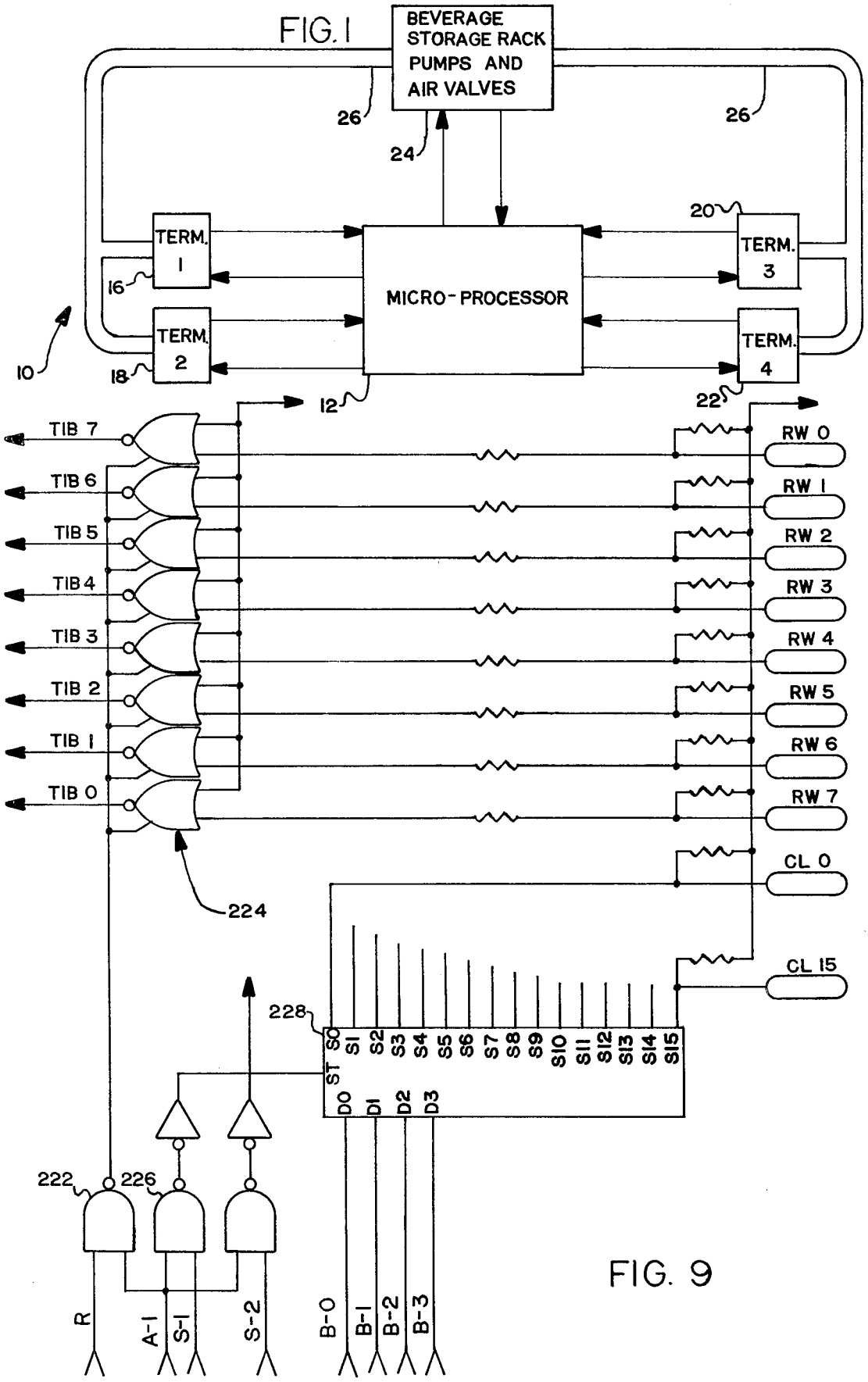
FIG. 9 is a schematic diagram of the keyboard scanning circuitry of the invention.

Referring now to the drawings and more particularly FIG. 1, it can be seen that the system of the invention is designated in block diagram form by the numeral 10. The system includes a microprocessor 12, which is preferably an RCA Cosmac Microprocessor, Model CDP1801, the details and operation of which are fully discussed in *User Manual for the Cosmac Microprocessor*, Copyright 1975, by RCA Corporation. The circuitry described hereinafter with reference to the preferred embodiment of the invention is set forth with such a microprocessor comprising the element 12.

Interconnected to the microprocessor 12 are a plurality of terminals 16–22. Each of these terminals includes a keyboard of operator-actuatable selector switches by which an operator may choose a drink or composition of drinks to be dispensed. Such drinks are dispensed at each of the stations by virtue of a dispensing head in communication with a beverage storage rack 24 by means of fluid conduits 26. Also associated with each of the terminals 16–22 is a cash register, cash display board, and dispensing solenoid valves, allowing each of the terminals 16–22 to function as a separate and independent dispensing station. It is contemplated that each of the terminals sharing processing time with the microprocessor 12 will be substantially identical to the terminals set forth in the aforementioned U.S. Pat. No. 3,991,911, held by the assignee of the instant application. Each such terminal is supplied with beverage from the storage rack 24, which contains therein the beverage reservoirs, pumps, and air valves necessary for effectuating the dispensing of the ingredients of the drink composition. Again, the reservoirs, pumps, and air valves are described in the aforementioned patent. It will also be seen that the microprocessor 12 communicates with the element 24 to control the pressurization and actuation of the pumps necessary for dispensing the beverages selected by the various terminals 16–22, all of which will be discussed in detail hereinafter. Suffice it to say at this time that the various terminals allow a plurality of operators, each at a different terminal, to select and dispense various beverages and combinations thereof from a central storage rack 24, all under control of a single microprocessor 12.

Figure 2:
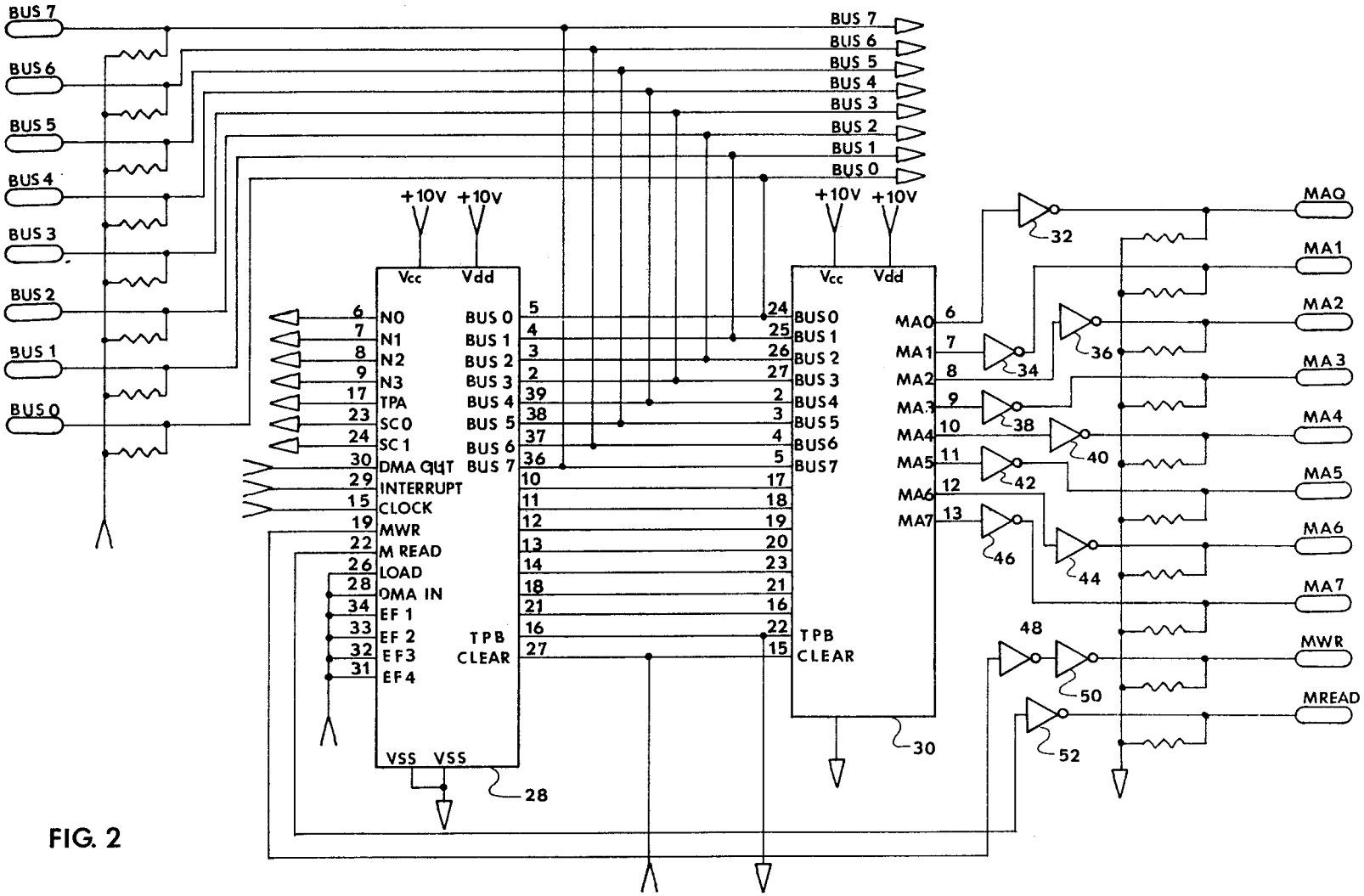
FIG. 2 is a schematic diagram of the microprocessor chips and inputs and outputs thereof, as utilized with the invention.

In FIG. 2 it can be seen that the microprocessor 12 includes processor chips 28,30, in standard fashion. Data is transmitted to and from the processor chips 28,30 via the data BUS lines, labeled BUSϕ–BUS7, as shown. Such communication will be elaborated upon hereinafter. The chip 30 communicates with the random access memory (RAM) and the programmable read-only memory (PROM) via memory address lines MAϕ–MA7 as shown. Inverters 32–46 respectively drive the address lines MAϕ–MA7 and are used solely for the purpose of providing an inverted output from the chip 30. Further control of the RAM and PROM is made via the memory write (MWR) and memory read (M READ) lines to control the transfer of data to or from the associated memory device. The inverters 48–52 are provided to obtain a desired signal strength and logic state for the MWR and M READ signals. The remaining signals shown as communicating with the microprocessor chips 28,30 are generated in and will be discussed with reference to the circuitry of FIGS. 3 and 5.

Figure 3:
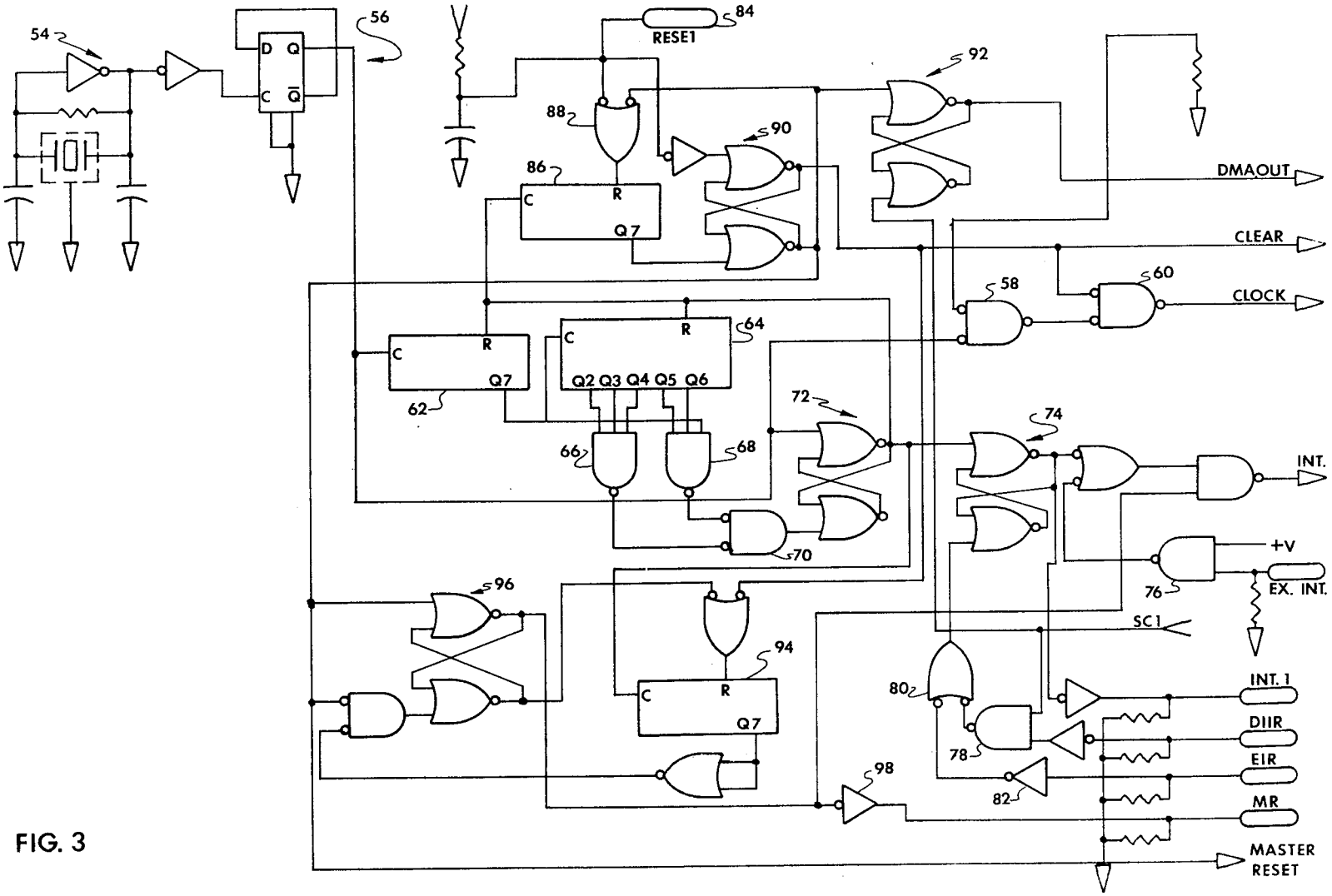
FIG. 3 is a schematic diagram of the clock generator and timing circuitry of the invention.

The circuitry of FIG. 3 provides the clock generation and timing circuitry for control of the microprocessor chips 28,30, discussed directly above. While any of numerous timing sequences could be devised by one skilled in the art, the circuitry of FIG. 3 is presented to show at least one approach toward the same. As shown, a crystal oscillator 54 of desired frequency provides an output to a squaring flip-flop 56, the output of which passes through the gates 58,60 to provide the basic processor clock which is applied to the chip 28 of FIG. 2. The squared output of the oscillator 54 is also applied to the counters 62,64, the outputs of which are decoded via the gates 66–70. The decoded output of the gate 70 toggles the latch 72, resetting the counters 62,64, to begin the count anew. It can be seen that the latch 72 is reset on the next output of the squaring flip-flop 56, such that the latch 72 presents a pulse every five milliseconds, for example; the exact time being determined by the decoding of the counters 62,64. The pulse output of the latch 72 toggles the latch 74, which gates an interrupt (INT) signal to the chip 28 as shown in FIG. 2. This INT signal provides a real time clock to the processor such that every five milliseconds the processor receives an interrupt pulse to send it into a subroutine under control of the programs of PROM, to be discussed hereinafter. An external interrupt pulse (EX INT) may be manually supplied by means of a switch or the like applied to the gate 76. A subroutine clock 1 pulse (SC1), supplied from the circuitry of FIG. 5 and generated by the processor chip 28, is operative through gates 78,80 to remove the INT signal at the end of a subroutine, resetting the latch 74. An external interrupt reset signal (EIR) may be applied from an appropriate switch or the like interconnected to the inverter 82, should an external interrupt have been applied via the gate 76.

When power is turned on via the power reset switch 84, the counter 86 is reset via the gate 88. Each output of the latch 72 then applies a count, through the counter 86, which is decoded such that, after a fixed number of such counts, the flip-flop or latch 90 is actuated to enable the processor by applying the CLEAR signal to the chips 28,30 of FIG. 2. This CLEAR signal also enables the clock pulse to be passed through the gate 60 to the chip 28 as set forth above. Since the latch 90 can only be reactuated by the reset switch 84 or upon reapplication of power, the counter 86 plays no further role in the operation of the circuitry of FIG. 3. It will also be noted that the latch 92 is also actuated by the output of the latch 90 to produce the DMA OUT signal applied to the microprocessor chip 28 to start the processor in operation and to restart the processor upon receipt of the SC1 signal after execution of each subroutine. It will be appreciated that the counter 86 provides a time delay during which the power applied to the system may stabilize after power turn-on, before any operations are executed.

It will be seen that a counter 94 is reset by the CLEAR signal output of the latch 90, which also resets the latch 96. The latch 96 applies a master reset signal through the inverter 98 to all of the dispensing terminals to clear all of the registers at the terminals. This master reset signal stays on after the CLEAR signal until the counter 94 counts a predetermined number of the clock signals emitted by the latch 72. After a predetermined number of such pulses are counted, the counter 94 emits a resetting signal to the latch 96 to change the state thereof, at which time the system is initialized to a state wherein dispensing and control operations may be performed.

Figure 4:
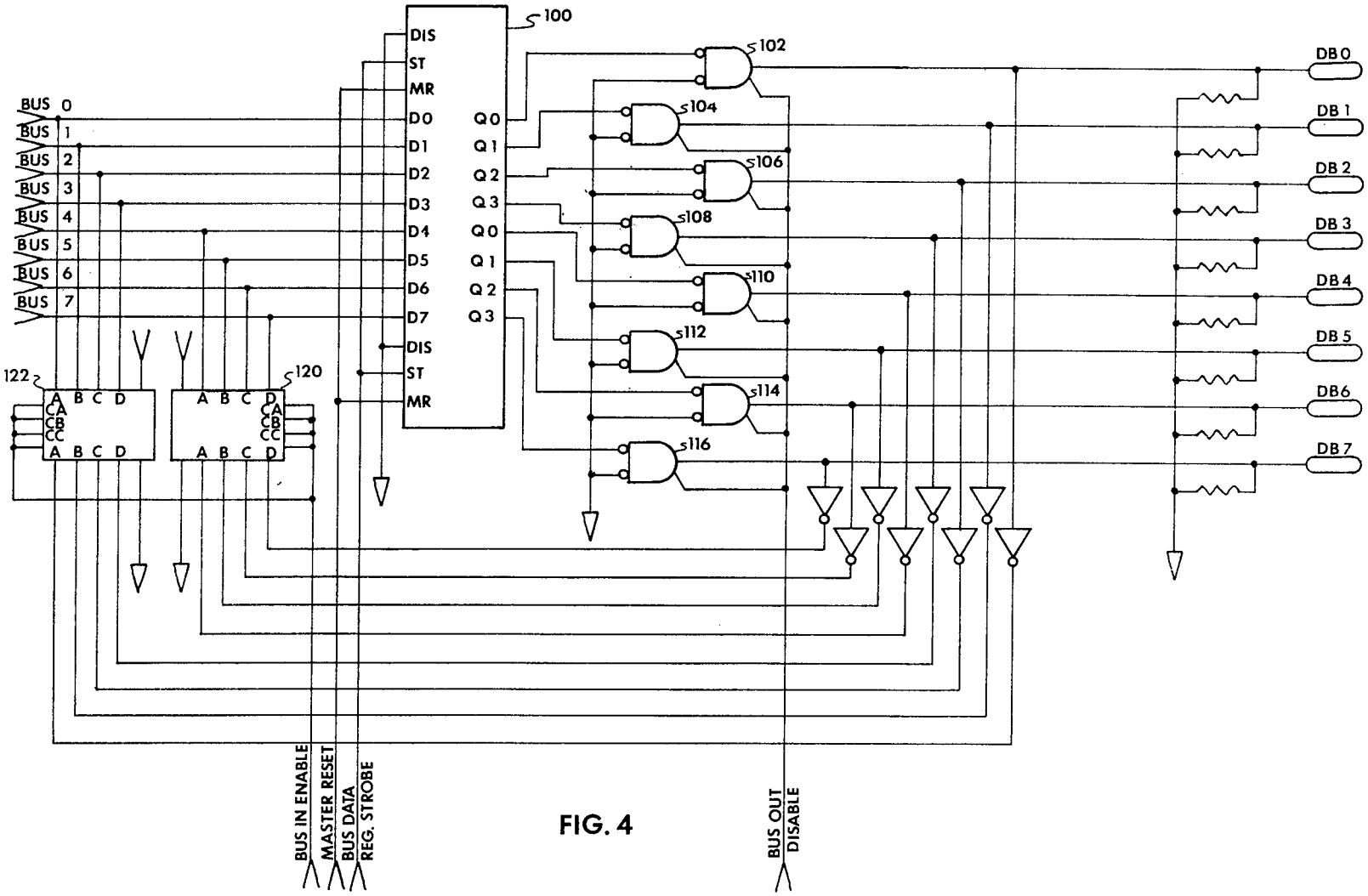
FIG. 4 is a schematic diagram of the interface circuitry of the invention.

A portion of the circuitry required for a transfer of data between the microprocessor 12 and the various terminals 16–22 is shown in FIG. 4. As can be seen, an eight-input register 100 is interconnected to the BUS lines of the microprocessor of FIG. 2 to receive inputs therefrom. The outputs of the register 100 may be applied through associated tri-state devices 102–116 to data BUS lines DBϕ–DB7 for communication with the various terminals, as will be described hereinafter. The tri-state gates 102–116 are of such nature that, when properly biased, the outputs thereof may be driven with no adverse effects to the gates. Under program control, if data is to be transferred from the various terminals 16–22, the BUS OUT DISABLE signal may be applied from the circuitry of FIG. 5 to the gates 102–116 as shown, and data may be transferred across the lines DBϕ–DB7 through the respective inverters 118, the switches 120, 122, and across the BUS lines back to the chips 28,30 of the microprocessor 12. The switches 120,122 are enabled by the BUS IN ENABLE signal output of the circuitry of FIG. 5, again under program control. In any event, it can seen from the circuitry of FIG. 4 that data may be transferred from the microprocessor, across the BUS lines, through the register 100 and gates 102–116, and to the various terminals via the DB lines. Similarly, data may be transferred from the various terminals across the DB lines, through the inverters 18 and switches 120,122, and to the microprocessor chips 28,30 via the BUS lines.

Figure 5:
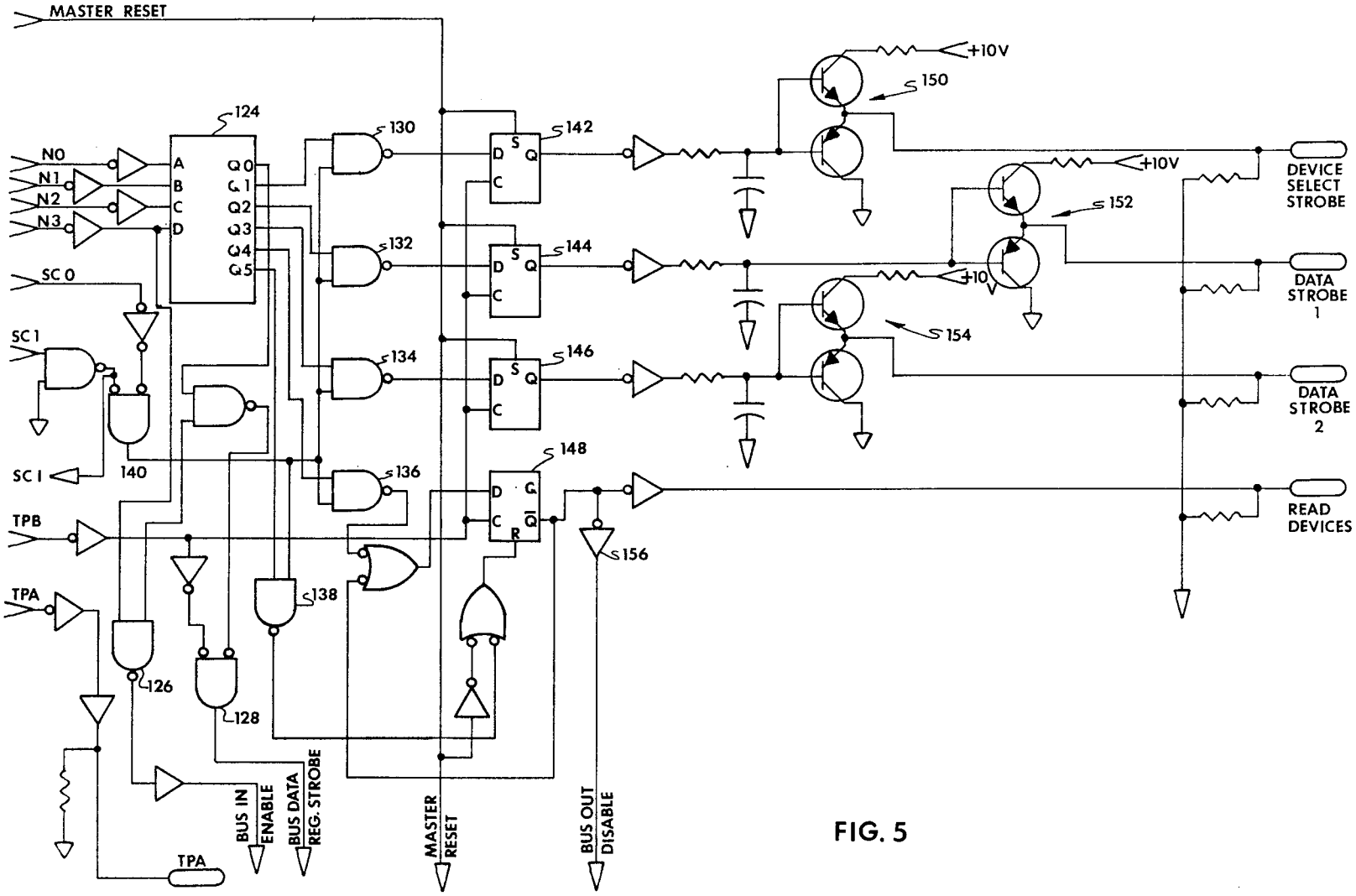
FIG. 5 is a schematic diagram of the strobe generator and read control signals of the invention.

Referring now to FIG. 5, the circuitry required for generating the various required control signals for the interrelationship between the microprocessor 12 and the various terminals 16–22 is presented. As shown, a decoder 124 is interconnected to receive the output signals Nϕ–N3 from the microprocessor chip 28. These signals comprise the timing and control signals generated by the processor chip under program control. These signals are combined with the SCϕ and SC1 signals generated by the microprocessor chip to control the input-output cycle thereof to generate, through gates 126,128 respectively, the BUS IN ENABLE and BUS DATA REG STROBE signals applied to the switches 120,122 and register 100 of FIG. 4. As discussed with respect to the circuitry of FIG. 4, these circuit elements control the transfer of data between the terminals and microprocessor chips.

The outputs of the decoder 124 are further applied to the gates 130–138, and gated by the state of the SCϕ and SC1 signals via the gate 140 to control the D-type flip-flops 142–148. A clock, timing pulse B (TPB), again from the microprocessor chip, controls the clocking of the flip-flops 142–148 to receive the data supplied from the associated gates 130–138. It will be noted that the flip-flops 142–148 are initialized by the master reset signal supplied from the output of the latch 90 of FIG. 3, which also initializes or resets the register 100 of FIG. 4. The outputs of the flip-flops 142–146 are applied to respective drivers 150–154, which correspondingly drive the device select strobe (DSS), data strobe 1 (ST-1), and data strobe 2 (ST-2). The output of the flip-flop 148 is the read device signal (RDD) which stays high for the time required to receive data from the various devices at the terminals under program control. It will also be noted that the output of the flip-flop 148 is gated through the inverter 156 as the BUS OUT DISABLE signal, which biases the tri-state devices 102–116 of FIG. 4, such that data may be transferred from the various terminals to the microprocessor as discussed hereinabove.

Figure 6:
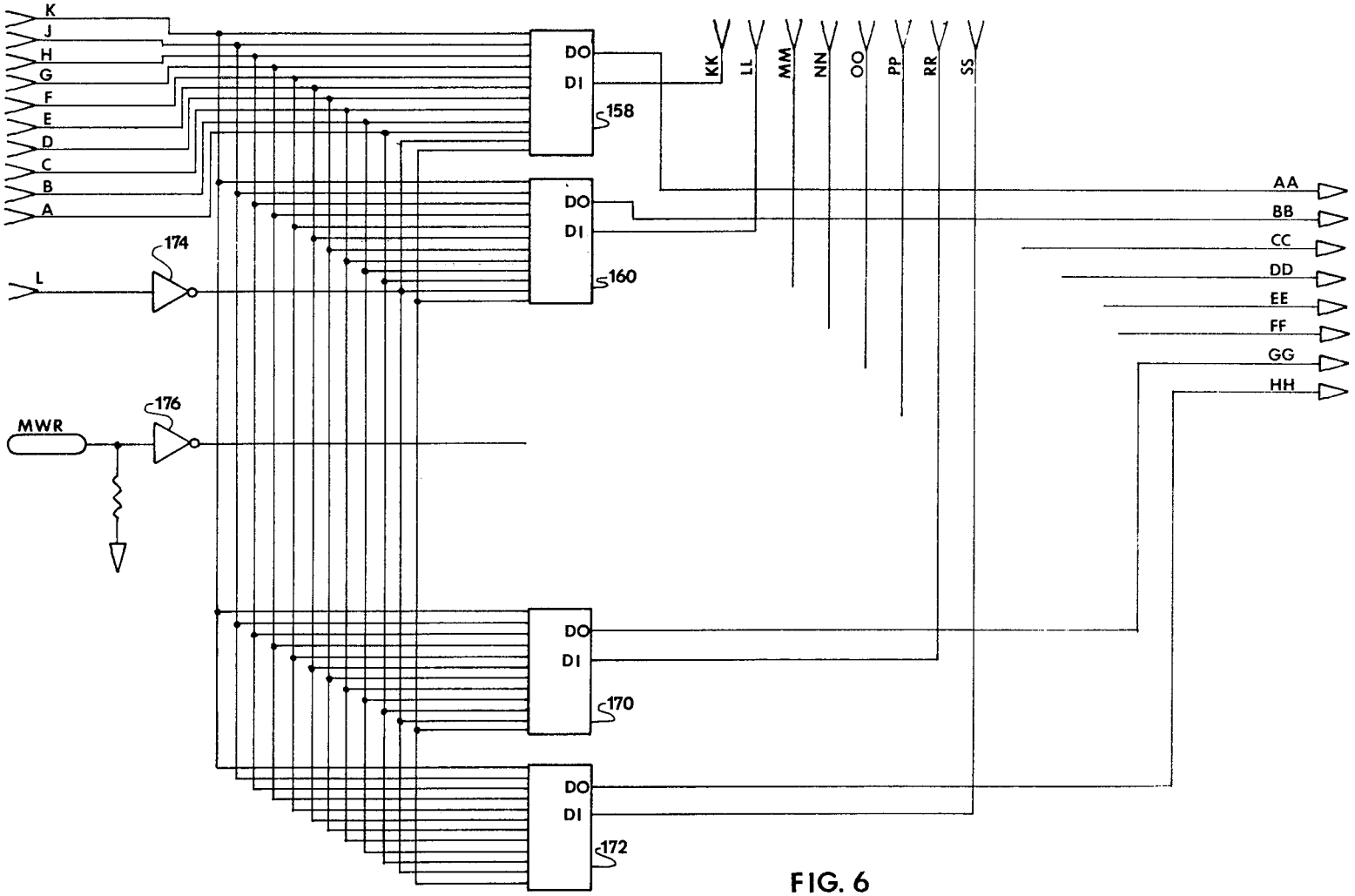
FIG. 6 is a schematic diagram of the random access memory of the invention.

FIG. 6 shows the random access memory array utilized in the invention for receipt and storage of data bits. As can be seen, the data array comprises eight RAM chips 158–172, each having ten address lines, such that each of the RAM chips 158–172 contains therein one bit of one thousand words, a word being accessed via the address lines. Each of the address lines of each of the memory chips is connected in common to corresponding address lines of all other chips for addressing by the circuitry of FIG. 7, to be discussed hereinafter. Each of the RAM chips also includes a chip select (CS) input gated through the inverter 174 from the circuitry of FIG. 7 to enable the RAM outputs in standard fashion. A write enable (WE) input is included and connected to the inverter 176 to enable the RAMs to receive data. The write enable input of each of the RAMs 158–172 is actuated by the MWR output of the microprocessor chip 28 under program control. It will also be seen that each of the RAM chips 158–172 has associated therewith a data output (DO) line and a data input (DI) line, these lines being respectively designated by AA–JJ and KK–SS.

Figure 7:
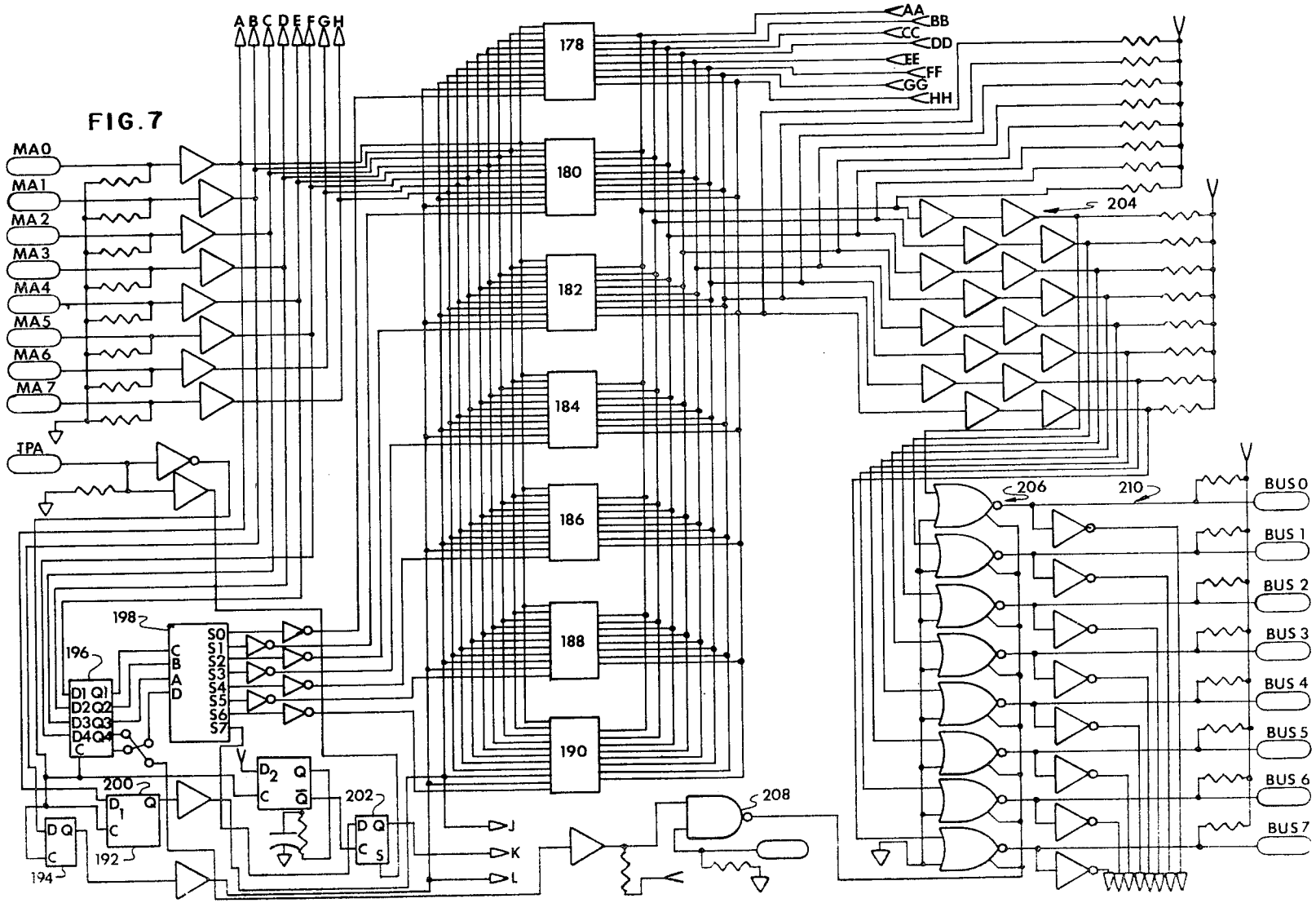
FIG. 7 is a schematic diagram of the programmable read-only memory utilized for maintaining the programs of the invention.

With continued reference to FIG. 6 and particular reference to FIG. 7, it can be seen that the programs of the microprocessor 12 are stored in programmable read-only memory chips (PROMs) 178–190. It will be understood that while the circuitry of FIG. 7 shows seven such PROMs, the invention is adaptable to an expansion of the number of PROMs and may, by merely duplicating the circuitry of FIG. 7 with minor alterations, comprise ten or more such PROMs. The PROMs are addressed by means of memory address lines MA supplied from the microprocessor chip 30 of FIG. 2. These same memory address lines connect to the RAM address input of FIG. 6 via interconnections A–H such that the lines MA contain a PROM address or a RAM address, depending upon the memory enabled by the microprocessor program.

When the PROMs are to be addressed, the address is supplied in two shifts of address data across the MA lines from the microprocessor chip 30. On the first shift, 6 bits of data are transferred across the lines MAϕ–MA5. Flip-flops 192,194 receive MAϕ and MA1 data respectively. The bits of data transmitted across MA2–MA5 are applied to inputs D1–D3 of the quad D-type flip-flop 196. The corresponding outputs Q1–Q3 of the flip-flop 196 are applied to the three least significant input bits of the one-of-eight decoder 198, the outputs of which are applied to the chip select (CS) inputs of the PROMs 178–190, as shown. Consequently, the one-of-eight decoder 198 selects the PROM to be enabled and accessed by the address transmitted from the microprocessor chip 30 across the MA lines. The D4 input of the flip-flop 196 is supplied across the lines MA5 with a corresponding output being supplied to the most significant input of the one-of-eight decoder 198. As shown, both the true and complement output for the D4 input of flip-flop 196 are utilized with the output jumpers being reversed when a second circuit, identical to that of FIG. 7, is to be used to expand the PROM capabilities. In any event, the signal transmitted from the microprocessor across MA5 selects the PROM circuit or board upon which the PROM chip to be addressed is located. It will be seen that the timing pulse A (TPA) clock controls the gating of the data into the flip-flops 192–196. It will be noted that flip-flops 200,202 are provided in interconnection with an output of the one-of-eight decoder 198 and the clock pulse TPA of the microprocessor chip 28 to decode the data transmitted on the lines MA to enable the RAM chips 158–172 if access is to be made to the RAM. The flip-flop 200 is merely provided for time delay purposes to allow the data from the decoder 198 and address lines to reach the flip-flop 202 for clocking the same. As can be seen, the output of the flip-flop 202 is provided to the chip select inputs of the RAMs 158–172.

Regardless of whether the PROM or the RAM is to be addressed, with the first set of data transfers having been made via the lines MA as just discussed, a second set of address data is transferred across the lines MAϕ–MA7 and to the least significant eight address input lines of the PROMs or RAMs. There is thus presented to each of the PROM or RAM chips a ten-bit address. If the RAM is accessed, depending upon the state of the WE input, all eight bits of the addressed word are either transmitted out via the lines KK–SS, or may be written thereinto via the lines AA–JJ. In the case of the PROM, data signals may only be transferred out, the selected PROM putting out the eight bits of the addressed word. The bits of data are transmitted through the buffer 204, through the tri-state devices 206, and to the microprocessor chips 28,30 via the BUS lines as shown. In this mode of operation, the M READ signal of the chip 28 of FIG. 2 is high, causing the gate 208 to bias the tri-state devices 206 into signal passing capability. If data is to be written from the BUS lines of the microprocessor into the RAMs, the M READ signal is low, biasing the devices 206 such that data may be driven from the BUS lines through the buffer 210 and into the data input (D1) of the RAMs 158–172 via the lines KK–SS of FIG. 6.

Thus it can be seen that data and control signals may be transferred from the RAM and PROM to the microprocessor via the BUS lines, and that data may be transferred back from the microprocessor chips to the RAM, all under control of the programmed microprocessor. In the instant invention the RAM includes registers to total cash received, credit charges, wine, beer, liquor, soft drinks, and miscellaneous items sold, as well as a register which receives the business conducted by each of the various waitresses or bartenders. All such totalizing is under control of programs maintained in the PROM and operating upon data received from the various terminals as discussed hereinafter.

Figure 8:
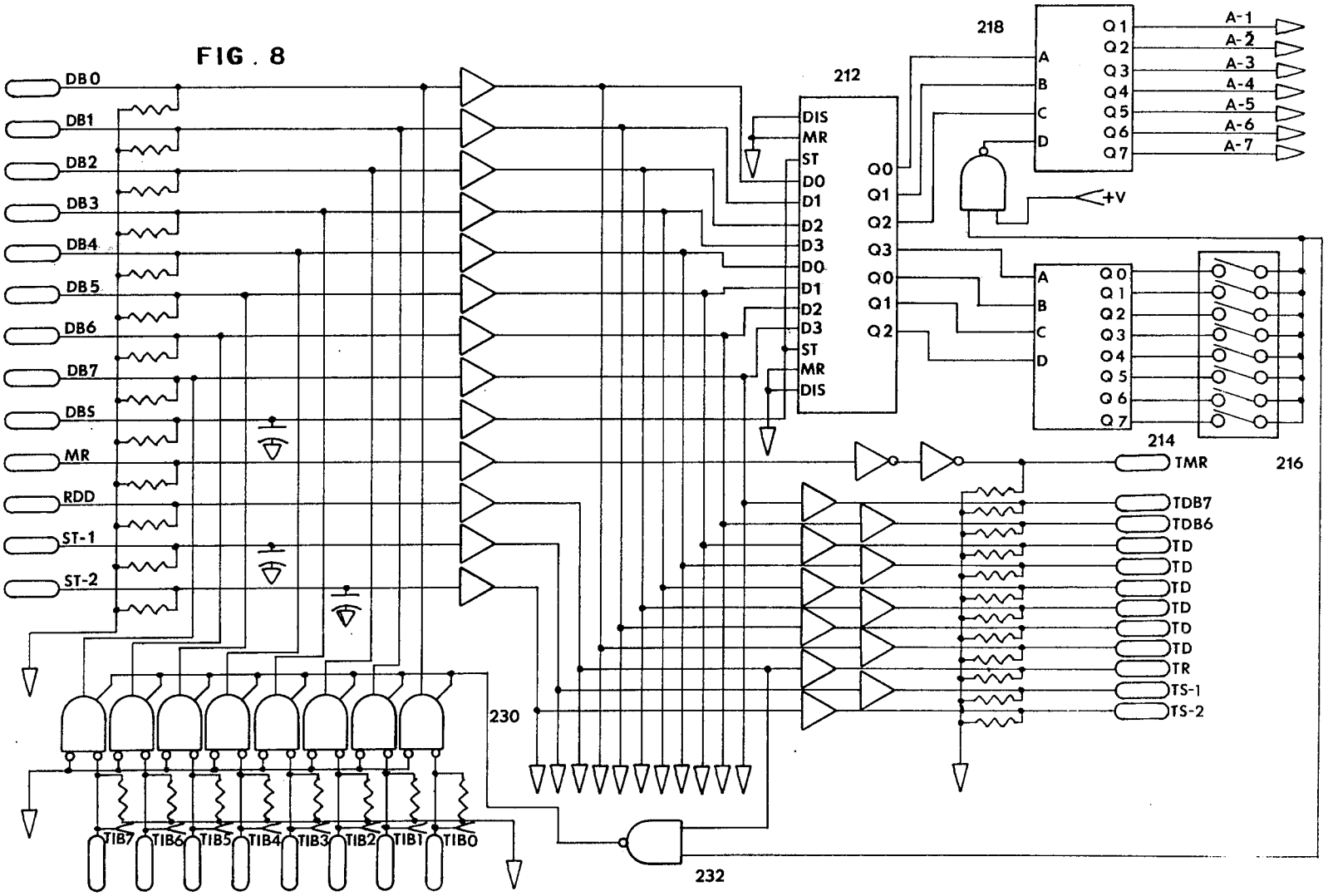
FIG. 8 is a schematic diagram of the device and terminal access circuitry of the invention.

At each of the terminals 16–22, there is provided terminal decode circuitry such as that shown in FIG. 8. It will be seen that eight DB lines are provided for communication to and from the microprocessor as shown in FIG. 4. Data bits from the microprocessor chips are applied to the eight input D-type flip-flops or register 212. Four of the outputs of the register 212 are applied to the decoder 214, the outputs of which are applied to the switches 216. In operation, each of the switches 216 is associated with a particular terminal, that terminal address being the input of the decoder 214. With each terminal 16–22 having the circuitry of FIG. 8 thereat, and with the switch 216 of that terminal being closed, addressing of that terminal results in an output of the switch 216 which enables the decoder 218 via the gate 220. The inputs to the decoder 218 are the device addresses or designations to be discussed hereinafter. In other words, the output of the switch 216 makes access to the addressed terminal, while the output of the decoder 218 is the decoded designation of the particular device at the terminal to be accessed. Thus, it can be seen that the elements 212–220 receive data from the microprocessor via the DB lines and under program control which makes access to a particular device at a particular terminal. While the system of FIG. 1 is shown to include only four terminals, it can be seen that the decoder 214 and switch 216 operates to select as many as eight such terminals.

It will be noted that the register 212 receives data from the DB lines under control of the device select strobe (DSS) generated by the circuitry of FIG. 5, discussed above. The RDD, ST-1, and ST-2 signals of FIG. 5 are also applied to the circuitry at each of the terminals. The master reset signal is also applied to the terminals as the terminal master reset (TMR) signal, as shown.

With reference now to FIG. 9, and continuing reference to FIG. 8, the circuitry for interrogating the keyboard of a selected terminal may be seen. As shown, a gate 222 enables a plurality of tri-state devices 224 upon receipt of a terminal read signal (TR) generated by the RDD signal of FIG. 5, and the receipt of the A-1 output of the decoder 218. The A-1 output indicates that the keyboard is to be selected. The gate 226, enabled by the A-1 signal, drives the strobe S-1 (ST-1 of FIG. 5), to strobe data into the decoder 228. The inputs to the decoder 228 are provided from the circuitry of FIG. 8 from the DBϕ–DB3 lines as shown. Each of the sixteen outputs of the decoder 228 is connected to a column on the keyboard (CLϕ–CL15), with the rows of the keyboard (RWϕ–RW7) being connected to the tri-state devices 224. As set forth in U.S. Pat. No. 3,991,911, the keyboard comprises a plurality of switches, 128 in this instance, with one located at the intersection of each row and column. With a switch actuated, the column output of the decoder 228 is connected to the row input of the associated tri-state device 224 and that tri-state device emits a corresponding output. Thus, as the columns are multiplexed by the programmed changing addresses applied on the Bϕ–B3 input lines of the decoder 228 and under control of the strobe S-1, the timing of the emitted output signal from the row-associated tri-state gates 224 identify the particular row and column at which an actuated switch is located. This data is transmitted from the tri-state devices 224 to the tri-state gates 230 of FIG. 8. The gates 230 are enabled by the application of the read devices (RDD) signal from the circuitry of FIG. 5 applied to the gate 232 to transmit the data back to the microprocessor via the DB lines. There is thus stored in the microprocessor information relative to the state of actuation of the switches on the keyboard, such switches representing drinks, components of drinks, functions, or the like as set forth in U.S. Pat. No. 3,991,911.

Figure 10:
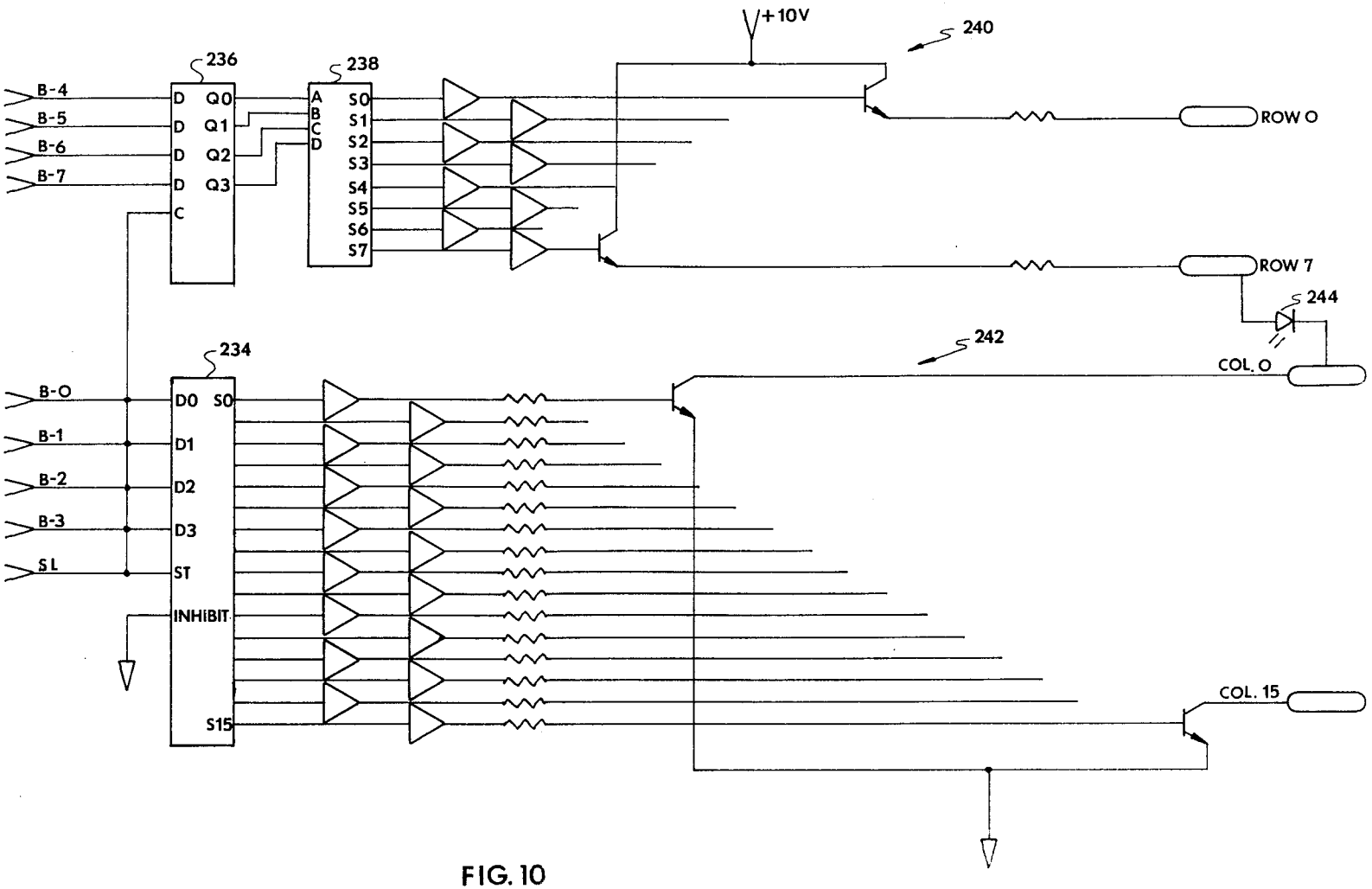
FIG. 10 is a schematic diagram of the circuitry required for illuminating the LED's of the keyboard of the invention.

Each of the switches, or selectable locations, on the keyboard is characterized by a light emitting diode (LED) for indicating the fact that the actuation of the switch has been sensed and stored by the microprocessor. The circuitry for illuminating the LEDs is shown in FIG. 10, and must, again, be considered in conjunction with the operation of the circuitry of FIG. 8. As shown, a decoder 234 receives data on the Bϕ–B3 lines from the circuitry of FIG. 8 respecting columns having actuated switches, while the quad D-type flip-flop 236 receives data via lines B4–B7, respecting rows having such actuated switches. The flip-flop 236 supplies such information to the decoder 238 which multiplexes through those rows having actuated switches. Control of both the flip-flops 236 and decoder 234 is via the select line (SL) signal output controlled by the strobe S-2 generated from the signal ST-2 of FIG. 9. In any event, as the row and column data is strobed through the elements 243–238, corresponding transistors 240,242 are enabled. Connected to the emitters of each of the transistors 240 are sixteen LEDs 244, one for each column. Each LED is connected to the collector of each of the transistors 240, such that simultaneous actuation of the two transistors interconnecting any LED 244 will result in the illumination of that LED, indicating to the operator that the switch has been actuated and data relative to that actuation has been stored in the microprocessor. With rapid multiplexing, the LEDs, while blinking, appear to be continuously lit.

Figure 11:
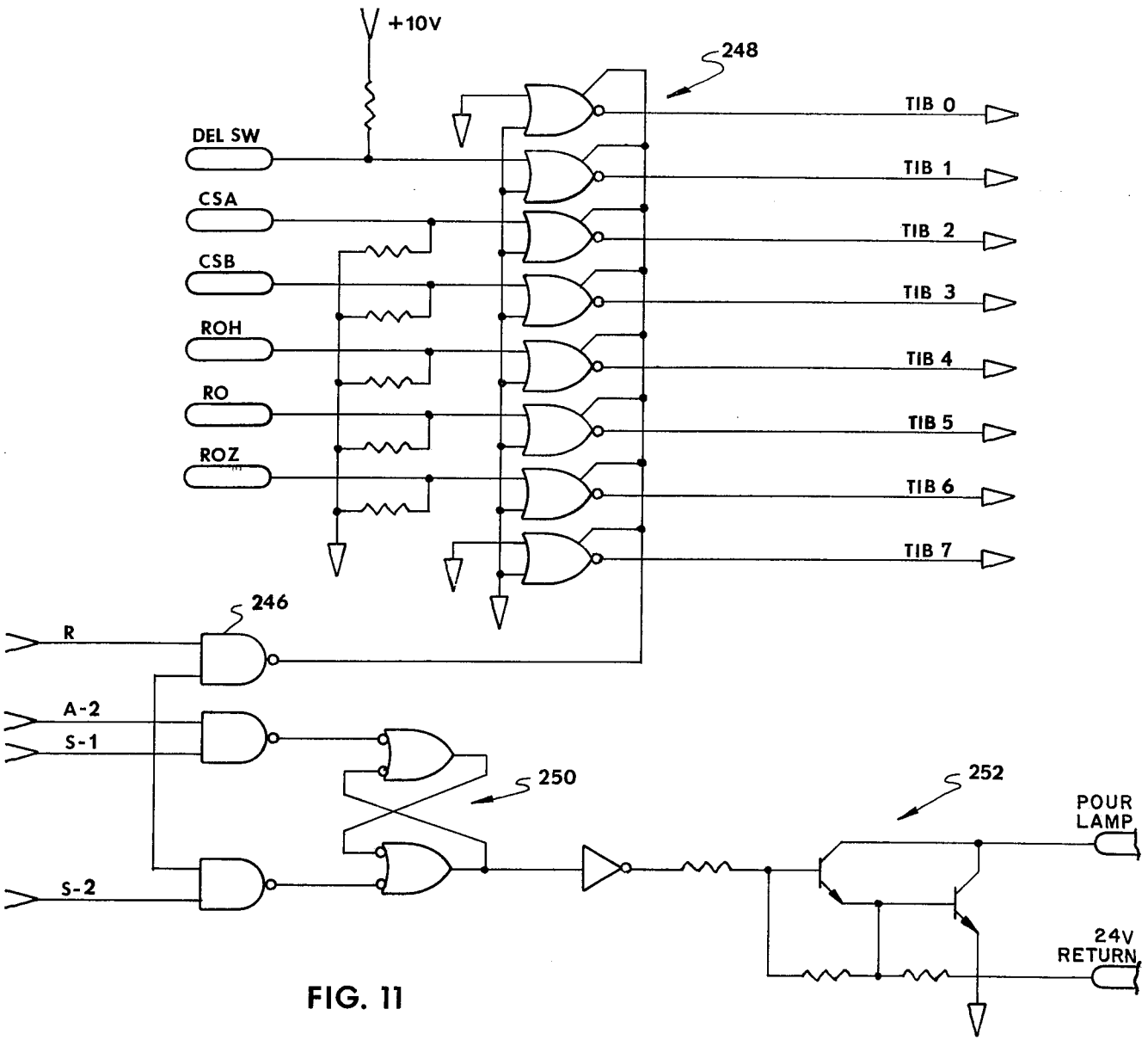
FIG. 11 is a schematic diagram of external control switches utilized for selecting particular subroutines of the invention and including the dispensing cycle thereof.

With reference to FIG. 11, further control circuitry at each of the various terminals 16–22 may be seen as the same relates to the circuitry of FIG. 8. When the control signal A-2 is emitted from the decoder 218, its application to the gate 246, along with the read devices signal R from the circuitry of FIG. 8, enables the tri-state gates 248 to transmit data back to the microprocessor via the tri-state devices 230 of FIG. 8. The data so transmitted may include data from the deliver switch (DEL SW) indicating that a glass has been placed under the dispensing head for dispensing of the drink. Further included are two cost switches (CSA and CSB), for selecting a single price for all drinks such as at "Happy Hour" or "Entertainment" time periods in the establishment utilizing the system, advising the microprocessor that all drinks are one price. Other switches include a ring-off home (ROH) signal, which tells the microprocessor that the terminal is unmanned and renders the same inoperative, a ring-off (RO) switch for ringing out the total of business conducted at that terminal since the last ring-off, and a ring-off zeros (ROZ) input for setting all zeros into the totalizing registers.

Strobes S-1 and S-2 are applied as shown in FIG. 11 to actuate the latch 250 to drive the driver 252 connected at each terminal to a pour lamp. When the deliver switch is actuated by the placing of a glass under the dispensing head, the pour lamp, connected to the driver 252, is energized by the latch 250 to illuminate and indicate that a dispensing cycle has been entered into.

It should be briefly stated that the output lines TDBϕ–TDB7 of FIG. 8 also communicate with the dispensing valves, paper tape print-out device, cash display, and the like located at each of the dispensing terminals 16–22. Such communication will be elaborated upon hereinafter.

It is to be understood that each of the terminals 16–22 of the centralized dispensing system of the instant invention includes a cash display unit evidencing the cost of each drink as it is being poured, and the total cost for all drinks purchased by a particular customer. The circuitry located at the terminal and interconnected with the microprocessor for creating such a cash display is shown, in part, in FIG. 12. It will be seen that inputs TDBϕ–TDB3 transmit data from the microprocessor as set forth in the circuitry of FIG. 8. This data is transferred to the shift registers 254–260, each receiving therein five bits of data under control of the clock supplied via TS-1 as enabled by the A-3 output of the decoder 218 of FIG. 8. The shift registers 254–260 may, of course, be cleared by resetting via the terminal master reset (TMR) signal, as shown. The shift registers 254–260 respectively transmit their five bits of data to the selectors 262–268. It will be understood that the cash display unit of the instant invention is a five-character display, each character requiring four bits of binary data. Consequently, the selector 262 may represent, for example, the least significant bits of data of each of the five characters, and progressively thereon with the decoder 268 containing the most significant bits of data of the five characters.

Figure 14:
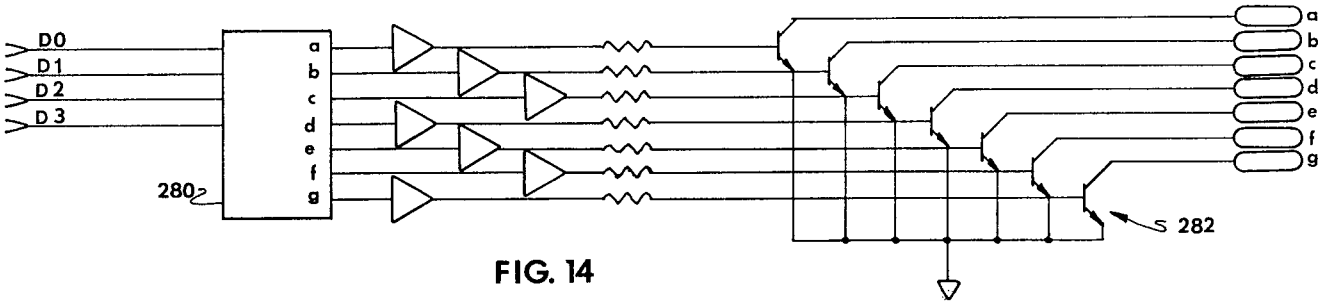
Figure 13:
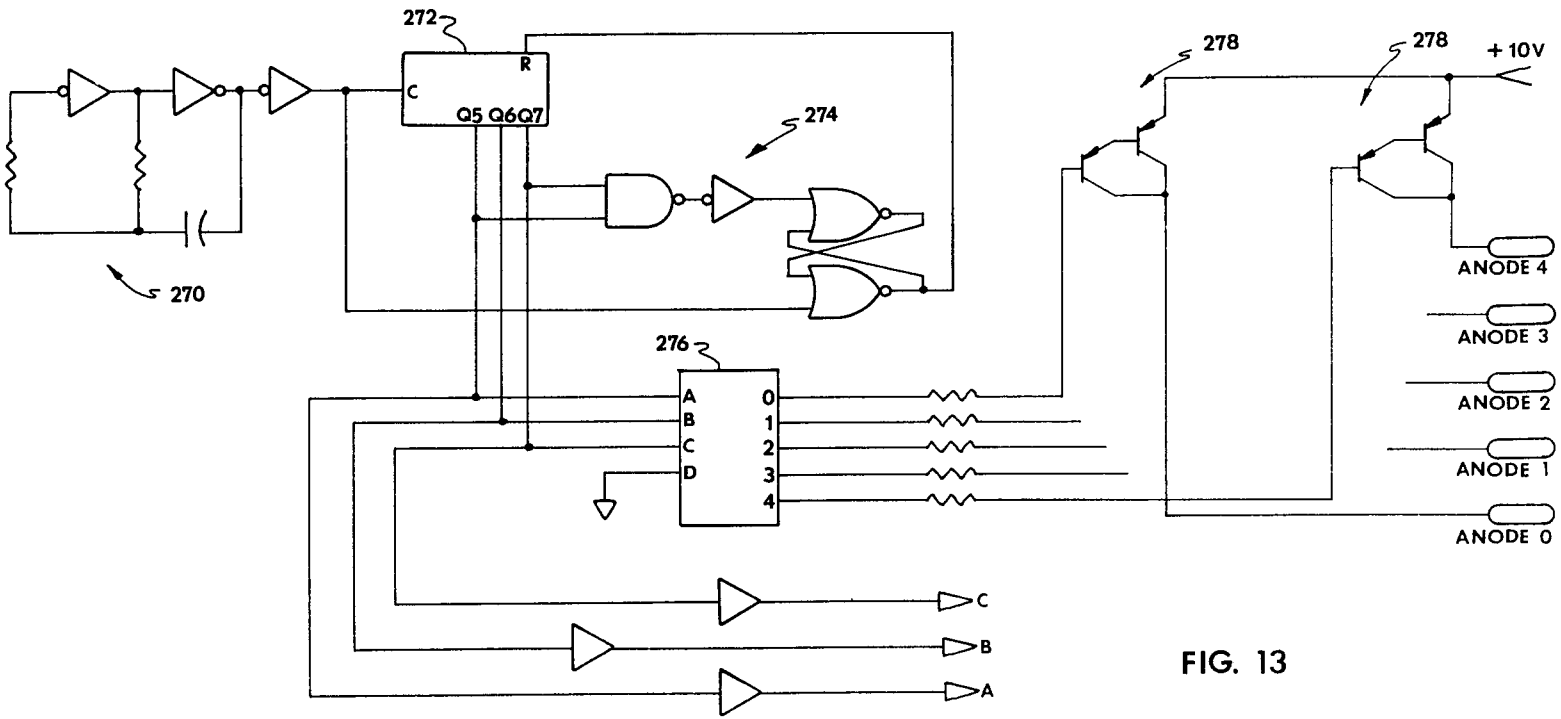

With brief reference to FIGS. 13 and 14, the circuitry utilized for addressing and receiving data from the decoders 262–268 will be seen. As shown, a multivibrator 270 is provided to clock a counter 272. The decoded outputs of the counter 272 feed a reset circuit 274, and are further applied to the inputs of the decoder 276. The outputs of the decoder 276 are connected to associated driver circuits 278, one associated with each of the characters of the display to be illuminated. The drivers 278 are connected to the anodes of the LED segment with the particular character and, hence, the LEDs of that segment may conduct for the period of time the associated driver 278 is energized as the multivibrator 270 causes the counter 272 to count.

The outputs of the counter 272, being the addresses of the characters of the display, are applied to the data selectors 262–268. The associated bits of data representing the addressed character are emitted as the outputs Dϕ–D3 and applied to the binary coded decimal to seven-segment decoder 280. These outputs are applied to the bases of the transistors 282 as shown, the collectors of the transistors 282 being connected to the cathodes of the LEDs of the segment displays. It will be understood that the display of each of the five characters is a seven segment display, as is standard in the art. As can be seen, an addressed character of the display has its driver 278 turned on via the decoder 276, thus biasing the anode of the display segment. The cathodes of the display segment are then selectively connected to ground via the output of the BCD to seven-segment decoder 280 driving the transistor array 282. It will be understood that the display is thus effectively multiplexed via the decoded output of the counter 272 such that each of the five display characters is on for approximately twenty percent of the time. However, with rapid multiplexing, the display unit appears to have a constant level of illumination.

Figure 12:
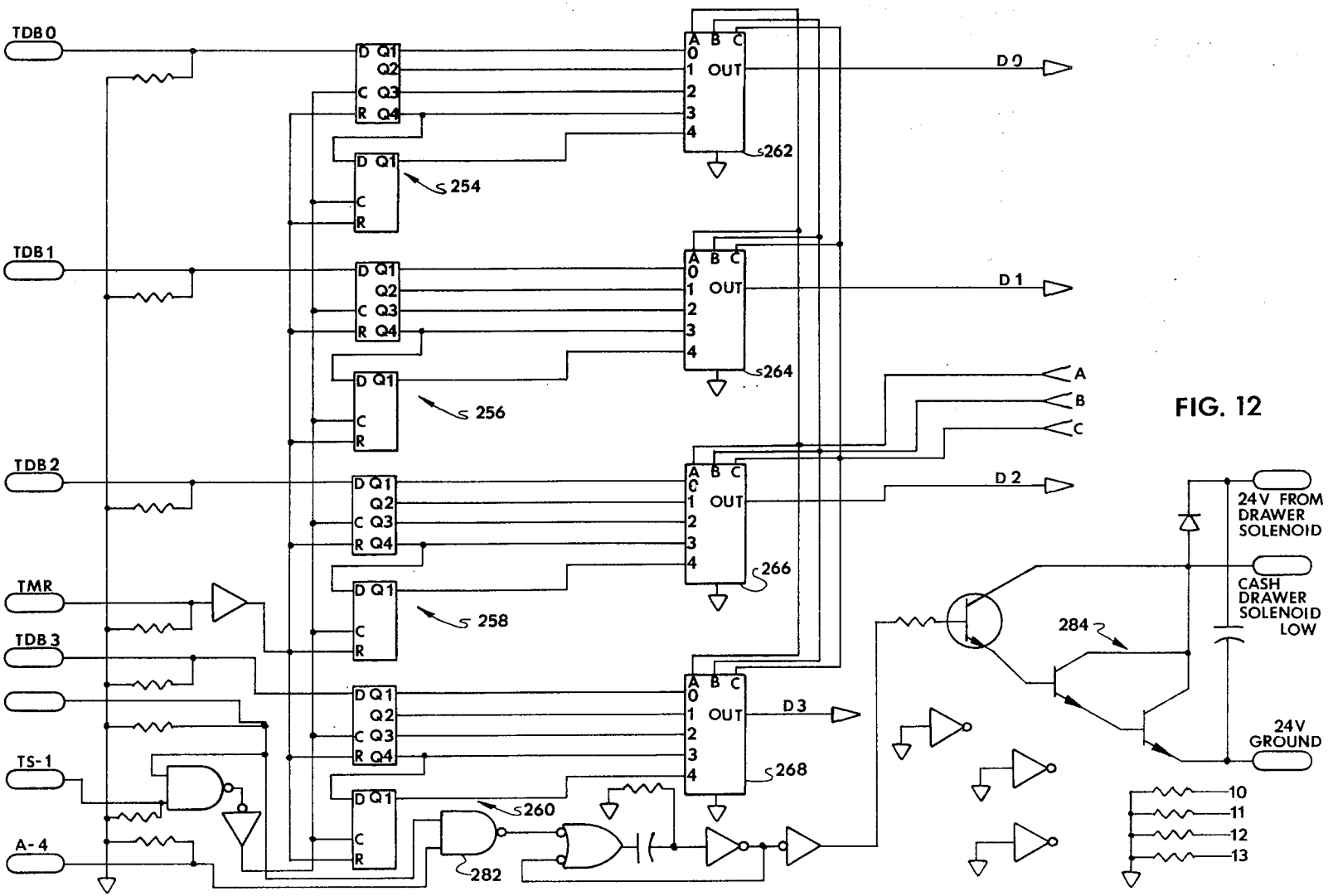
FIGS. 12–14 comprise the circuit schematic of the cash display driver of the invention.

It should be understood that the cost sent to the display register via the TDB lines of FIG. 12 is determined by the aggregate of prices evidenced by each of the selector switches of the keyboard array and sensed by the microprocessor via the circuitry of FIG. 9, discussed hereinabove, and, of course, under program control. The microprocessor is, of course, programmed to correlate switches of the keyboard with prices, and the chips 28,30 perform the necessary arithmetic functions for the desired totals.

With further refrence to FIG. 12, it can be seen that the output A-4 of the decoder 218 of FIG. 8 is functional for operating the cash drawer of the associated terminal. The concurrence of an A-4 signal and a TS-1 clock at the gate 282 triggers the driver 284 to actuate the cash drawer solenoid and allow the drawer to open. A cash switch on the keyboard, being sensed by the microprocessor, may generate the A-4 signal required.

Figure 15:
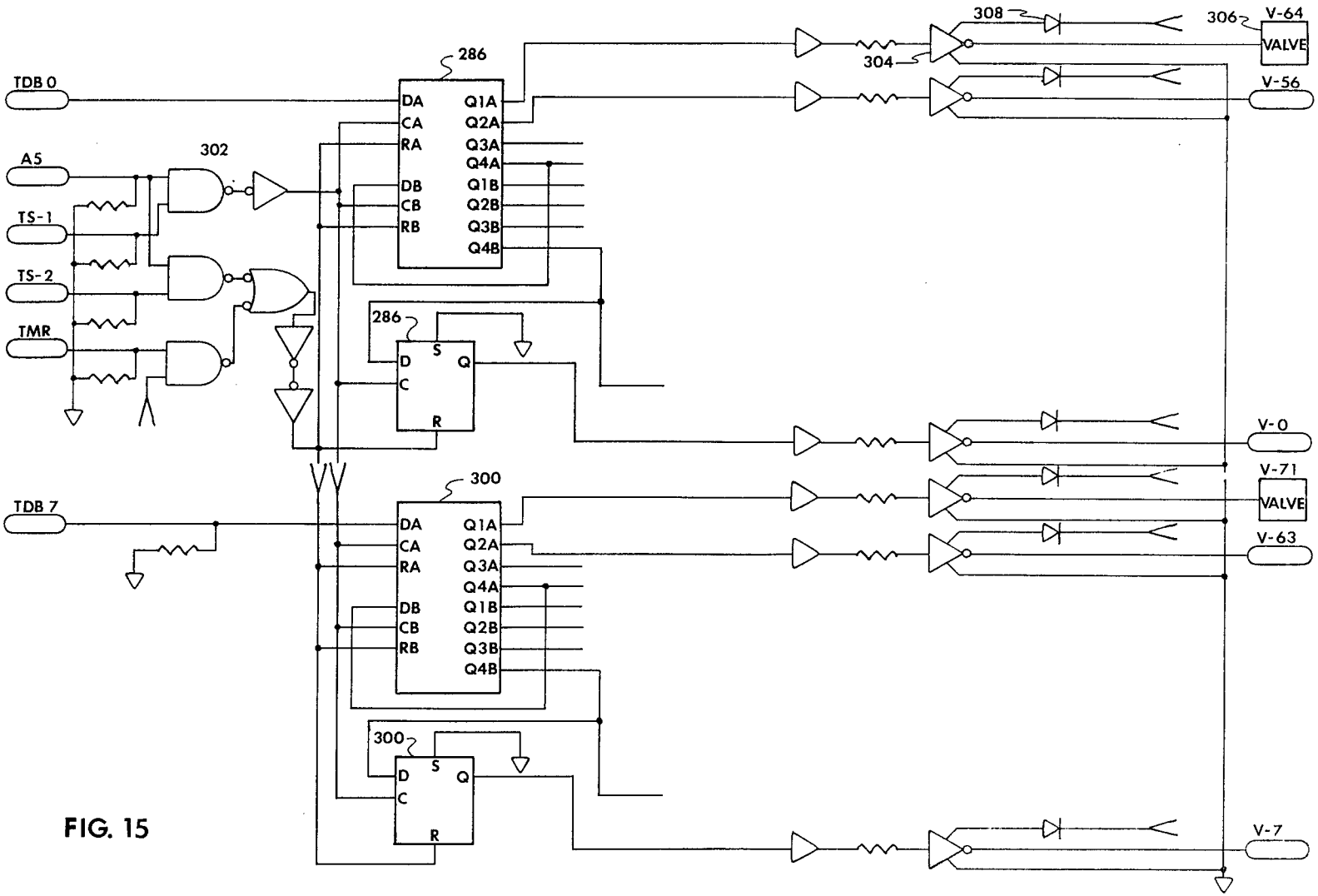
FIG. 15 is a circuit schematic of the valve driver of the invention for controlling the dispensing of beverages as selected upon the keyboard.

In the system of the invention, each terminal has associated therewith a conduit or line for each of the beverage components which may be dispensed. These lines are connected together at a dispensing head and each line includes therein a a solenoid-actuated valve for opening a keyboard-selected line to dispense a predetermined amount of the component upon actuation of the pour switch at the terminal. In FIG. 15, the valve driver and control circuitry associated with these solenoid valves is shown in detail. A plurality of shift registers 286–300 are interconnected to the eight TDB lines from the terminal decode circuitry of FIG. 8, as shown. The clock for the shift registers 286–300 is provided via the terminal strobe TS-1 through the gate 302 when the gate is enabled by receipt of an A-5 signal from the decoder 218 of FIG. 8, this output selecting the valve drive circuitry. Resetting of the shift registers 286–300 is under control initially of the terminal master reset signal (TMR) or, upon completion of a dispensing cycle, by the terminal strobe TS-2.

In operation, the data relative to the components to be dispensed as selected by the keyboard and sensed by the microprocessor on the A-1 command, is sent to the shift registers 286–300 under control of the terminal strobe TS-1. Each of the shift registers receives nine bits of data and, consequently, each includes an eight-bit shift register and a D-type flip-flop for the ninth bit. With eight shift registers of nine bits each, it can be seen that there are seventy-two valves which may dispense drink components. The outputs of the shift registers, being high to indicate that the component associated therewith has been selected, gate a transistor drive circuit 304, which may be, for example, a darlington circuit. The darlington circuit actuates the solenoid valve 306 to open the line for the dispensing cycle before termination by a TS-2 signal, or the strobing of new data into the shift registers 286–300. It will be understood that if a drink consists of several components in different amounts, data may be shifted anew into the registers 286–300 each time that termination of the dispensing of one component is required, data relative that component being absent on the subsequent shift. Of course, all such timing is under program control.

It will be noted that a diode 308 is interconnected between the valve and transistor drive circuit 304 to suppress induced voltages in the valve coil. It will further be appreciated that upon actuation of the pour switch at the terminal, the A-5 signal may be produced under program control to rapidly clock the data relative to selected components into the shift registers 286–300 and to hold such data on the outputs of the shift registers during the dispensing cycle until the same is terminated in the manner just discussed. The shifting of data through the shift registers is so rapid that the solenoids of the valves 306 do not have time to respond to voltage changes on the outputs of the shift registers during the shift.

Figure 16:
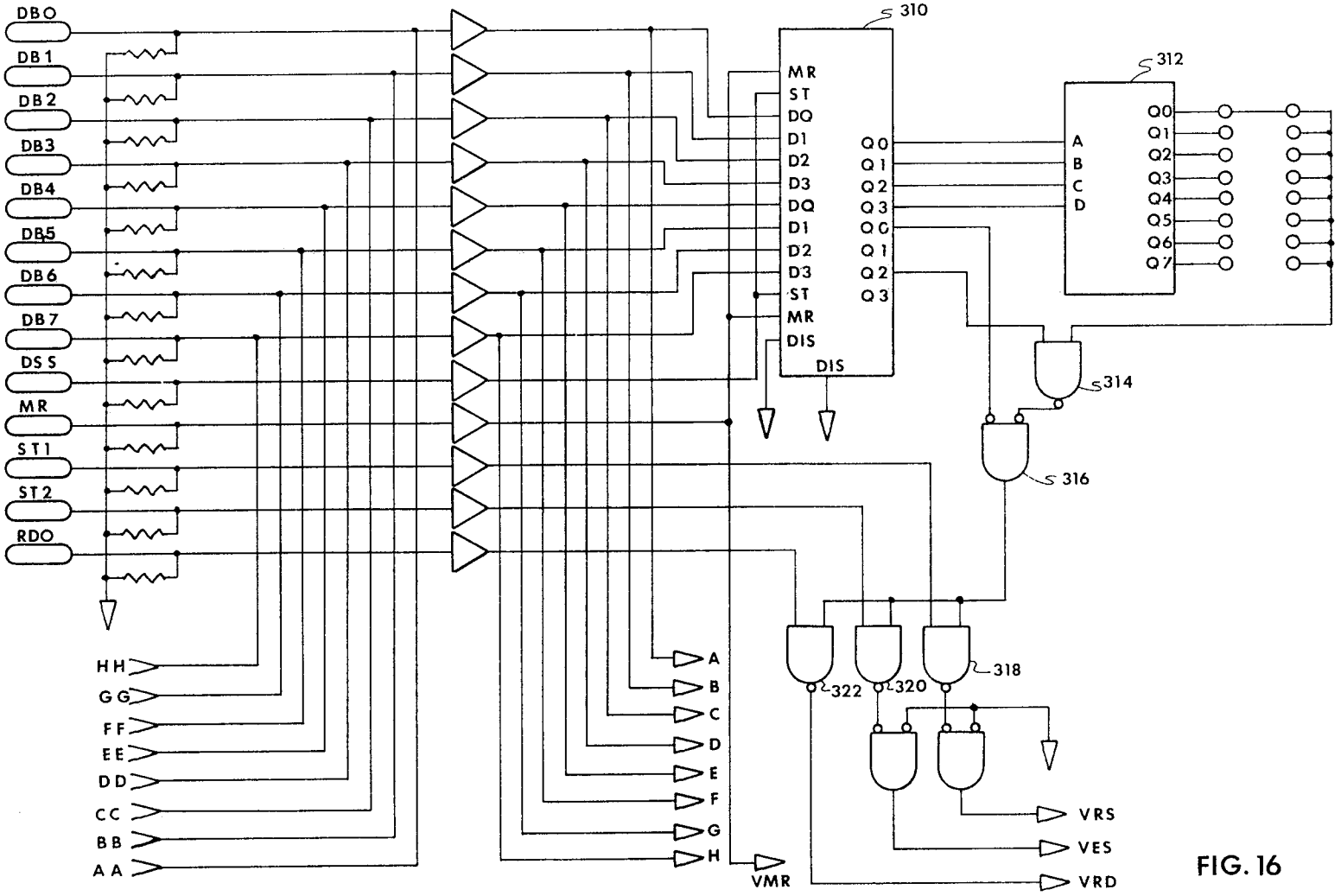
FIG. 16 is a circuit schematic of the decode circuitry for driving the air valves and empty sensors at the storage rack of the invention.

As mentioned hereinabove, the storage rack 24 includes a plurality of pumps, one for each of the beverages which may be dispensed, and a number of air valves for pressurizing the pumps. Of course, each air valve may service a number of pumps so that unnecessary duplication of equipment is circumvented. In any event, when a beverage or composition thereof is selected by means of the keyboard, and the deliver switch is activated by the placing of a glass under the dispensing head, it is necessary to energize certain air valves to pressurize the pumps required for dispensing the selected ingredients. The circuitry for such control is, of course, interconnected with the microprocessor 12, and is located at the storage rack 24. The circuitry is shown in FIG. 16 to include a register 310 receiving signals from the microprocessor 12 over the DB lines from the circuitry of FIG. 4. This data is strobed in via the device select strobe (DSS) of FIG. 5 and decoded via the decoder 312 to indicate that the transfer is to be made between the mircoprocessor and storage rack. As can be seen, further decode circuitry includes the gates 314,316 to enable the gates 318,320,322. The gate 318 passes the strobe signal ST-1 to the air valve register, via signal VRS while the strobe signal ST-2 is passed to the valve empty sense registers via signal VES. The gate 322 passes the read devices signal RDD to read the empty sensor, all of which will be discussed hereinafter.

Figure 17:
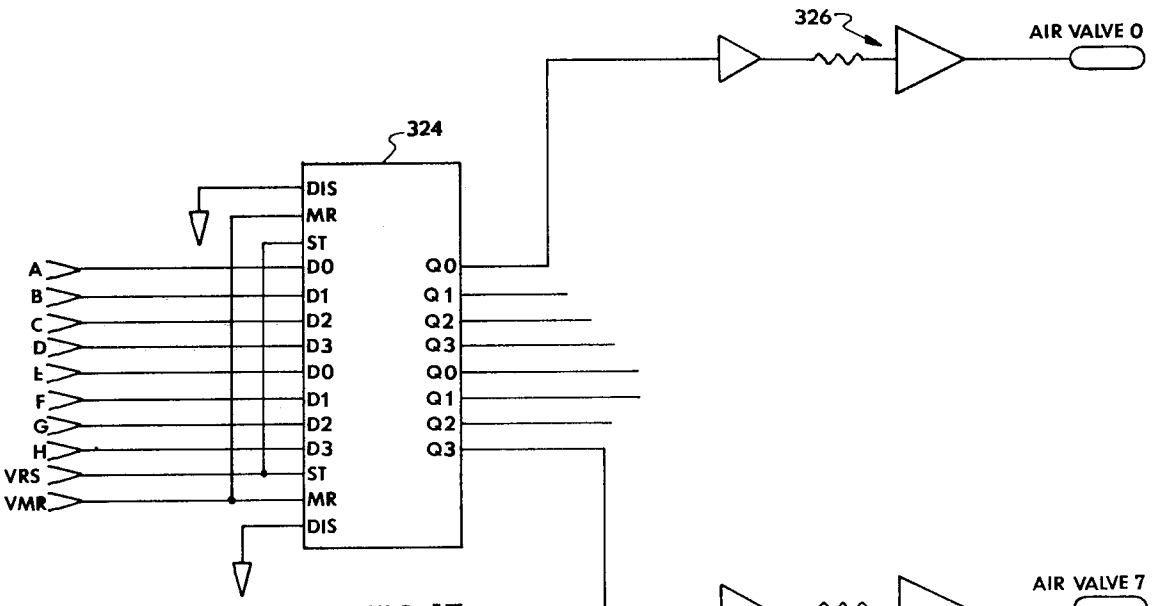
FIG. 17 is a circuit schematic of the valve driver register and valve drivers of the invention.

With reference now to FIG. 17, it can be seen that a register 324 is provided in interconnection with the seven data outputs of the DB lines of FIG. 16. This data is strobed into the register 324 via the valve register signal (VRS) output of the circuitry of FIG. 16, as controlled by the decoder 312–316 and the strobe ST-1. When the pour switch is actuated, the data stored in the microprocessor respecting the ingredients selected via the selector switches of the keyboard is used to determine, under program control, the air valves necessary for actuation. This data is transmitted via the DB lines to the input of the register 324 and strobed in via the VRS signal. The outputs of the register 324 are connected to the valve drivers 326, each of which drive an associated air valve. As shown in FIG. 17, there are eight such air valves required. At the end of the dispensing cycle, as determined by program control, data applied to the register 324 is changed via the DB lines and under control of the strobe VRS, such that the air valves may be turned off. Indeed, if the dispensing period for one component is different from that of another, the air valves may be sequentially turned off during the total dispensing cycle by appropriate update on the DB lines. It should be understood that the air valves pressurize the pumps at the storage rack 24 to drive the associated beverage or fluid ingredient through the tubular conduits 26 and out of the dispensing head at the terminal whose dispensing valves are actuated, as discussed hereinabove.

Also included as part and parcel of the instant invention, and provided at the storage rack 24, is circuitry for sensing and determining the beverage-containing reservoirs which are empty or maintain beverage below a particular level. The specifics of this circuitry are shown in copending application Ser. No. 875,201, filed Feb. 6, 1978, and entitled "RESERVOIR SENSOR." FIGS. 18 and 19 of the instant application teach the circuitry required for interconnection with the microprocessor 12 to achieve the desired result.

Figure 18:
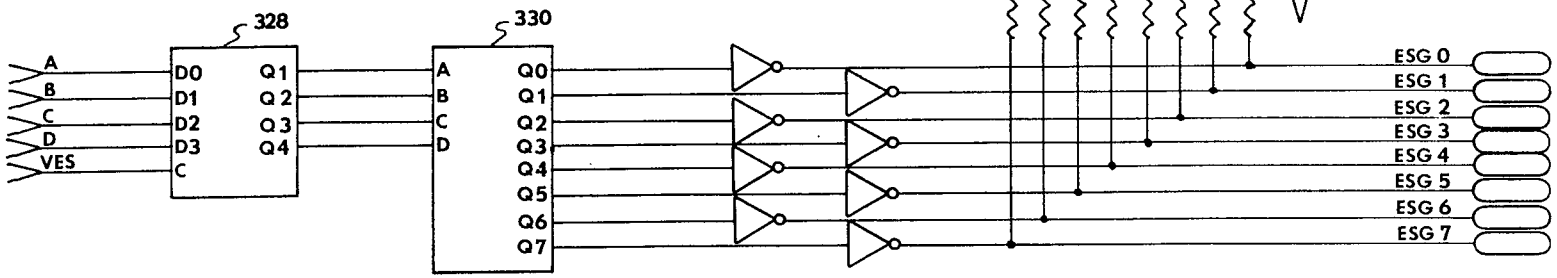
FIGS. 18 and 19 are circuit schematics of the empty sensors utilized with the reservoirs of the invention.
Figure 19:
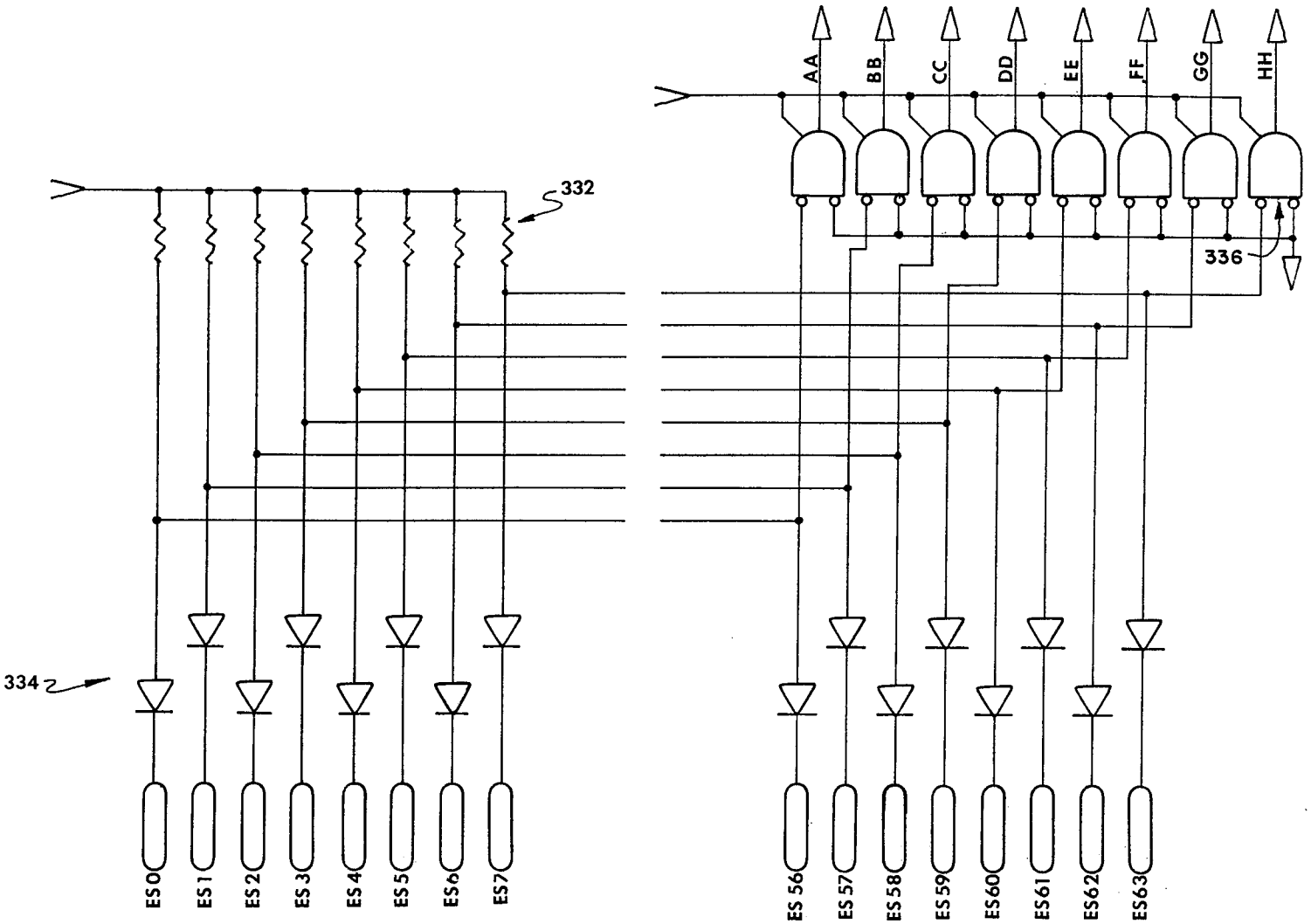

It can be seen in FIG. 18 that a register 328 receives data from the microprocessor via lines DBϕ–DB3, such data being clocked via the empty sensor signal VES generated by the strobe ST-2. The outputs of register 328 is passed to the decoder 330, which activates one of eight outputs thereof. With the reservoirs containing the beverages being arranged in rows and columns, as discussed in the referenced copending patent application, each of the outputs of the decoder 330 are driven to one side of the empty sensor switches of all reservoirs in an associated row. It will be appreciated that with the microprocessor 12 multiplexing through the row addresses, low voltage levels will be applied on a row-by-row basis to one side of all empty sensors common to the row. With reference to FIG. 19, it can be seen that connected to the other side of the empty sensor switches is a positive voltage applied through resistors 332 and in common to all empty sensor switches in a given column in the reservoir array. Of course, isolation diodes 334 are included. The column of empty sensor switches are connected to associated tri-state devices 336, one for each column. As the decoder 330 successively interrogates the rows of empty sensors, under control of the microprocessor via the lines DBϕ–DB3, a signal is emitted from the associated tri-state devices 336 for any reservoir whose switch is not activated due to a low beverage level. The tri-state device 336 emitting such a signal is indicative of the column in which such reservoir is maintained and the time at which such signal is emitted, in relation to the multiplexing of the register 328, is indicative of the row. This information is emitted from the tri-state devices 336 to the microprocessor via the lines DBϕ–DB7 in a manner described hereinabove. With the information so transmitted, the microprocessor may determine the beverage which is low and signal each of the keyboards of that fact by causing the LED associated with that beverage on the keyboard to blink, again under program control. The operators are thus informed as to the inability of the system to dispense that beverage, or drinks using that beverage in combination with other beverages, and the refilling of the reservoir may be made.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Consequently, for an appreciation of the scope and breadth of the invention, reference should be had to the following claims.

What is claimed is:

1. Apparatus for dispensing drinks from a central storage system to any of various dispensing terminals in accordance with preprogrammed or operator-selected formulations, under control of a centralized processing system, comprising:

a plurality of centrally located beverage reservoirs, each in communication with a pump associated with that beverage;

a plurality of dispensing terminals, each in communication with each said pump via fluid-passing conduits, said conduits combining to form a dispensing head at each said terminal, said terminals further including a keyboard of operator-actuatable selection means for selecting a drink or components thereof to be dispensed;

programmable computer means interconnected between said reservoirs and said dispensing terminals, for communicating therebetween and controlling the dispensing of selected drinks to the dispensing heads of selected terminals from said centrally located beverage reservoirs; and a plurality of shift registers at each dispensing terminal having the outputs thereof operatively connected to and controlling respective dispensing valves at said terminal, one dispensing valve for each said beverage, said computer means communicating data to said shift registers respecting the beverages to be dispensed for a selected drink and continually updating said data during the dispensing of said selected drink, thereby controlling the periods of dispensing of each component of said drink.

2. The apparatus as recited in claim 1 wherein said pumps are valve-actuated, driven by valve drivers, said valve drivers being connected to said computer means and selectively actuated thereby and for periods of time determined by said computer means.

3. The apparatus according to claim 1 wherein said computer means includes a first memory array for maintaining control programs, and a second memory array for receiving and maintaining data.

4. The apparatus according to claim 3 wherein said second memory array includes a plurality of registers receiving and maintaining therein data respecting dispensing operations at each of the various terminals.

5. Apparatus for dispensing drinks in accordance with preprogrammed or operator-selected formulations, comprising:

storage means for maintaining therein beverages for dispensing in the various formulations;

a plurality of dispensing terminals, each in communication with said storage means, each terminal including both a selection means for allowing the operator to select the formulations to be dispensed, and a dispensing means connected to said storage means for dispensing the drinks according to the selected formulations;

central control means interconnected between and in communication with said terminals and said storage means for sensing from each of said selection means the respectively selected formulations for dispensing at the various terminals and controlling the dispensing at said terminals from said storage means;

circuit means at each said dispensing terminal connected to said central control means for allowing each respective terminal to mutually exclusively communicate with said central control means, each said circuit means at each said terminal including first decode means for receiving signals from said central control means and determining from said signals if the associated terminal is accessed for communication with said central control means; and second decode means in interconnection with and receiving signals from said central control means for selecting one of a plurality of devices at the associated terminal for communication with said central control means, and wherein one of said devices comprises a keyboard of operator-actuatable selection means, said keyboard at a particular terminal being accessed by said first and second decode means; and a plurality of shift registers at each dispensing terminal having the outputs thereof operatively connected to and controlling respective dispensing valves at said terminal, one dispensing valve for each said beverage, said central control means communicating to said shift registers the beverages to be dispensed in a selected formulation.

6. The apparatus according to claim 5 wherein said second decode means is connected to and controlled by said first decode means, said second decode means producing an output only when the first decode means determines that the associated terminal is accessed for communication with said central control means.

7. The apparatus according to claim 5 wherein the selection means of each said keyboard is arranged in rows and columns, said central control means making multiplexing accessing to said columns and sensing outputs from said rows to determine the actuation of any of said selection means.

8. The apparatus according to claim 7 wherein one of said devices includes a display means for receiving signals from said central control means indicative of the state of actuation of said selection means at said associated terminal and displaying a price determined by said state of actuation.

9. The apparatus according to claim 7 wherein said storage means includes sensor means in communication with said central control means for determining when the quantity of a particular beverage in said storage means is below a predetermined level, said central control means indicating such situation to each of said keyboards.

10. The apparatus according to claim 7 wherein one of said devices comprises a dispensing head in communication with said storage means, said dispensing head including a plurality of fluid-passing conduits controlled by said dispensing valves, said dispensing valves being selectively actuated by said shift registers under control of said central control means in response to communication between said central control means and said associated keyboard.

11. The apparatus according to claim 10 wherein said storage means includes a plurality of pump means, one for each of said beverages, for driving the associated beverages through said fluid-passing conduits, said pump means being connected to and controlled by said central control means for actuating the pump means as selected by said selection means.

12. The apparatus according to claim 11 wherein said pump means includes air valves, each air valve servicing a plurality of pumps.

13. The apparatus according to claim 5 wherein said central control means comprises a microprocessor, said microprocessor communicating with two memory arrays, a first memory array maintaining therein programs for control of said microprocessor, and a second memory array for maintaining data therein.

14. The apparatus according to claim 13 wherein said first and second memories share a common set of address lines, said microprocessor selecting the memory array to be accessed, said arrays being accessed mutually exclusively.

* * * * *